US008329254B2

(12) United States Patent
Matsushita

(10) Patent No.: US 8,329,254 B2
(45) Date of Patent: Dec. 11, 2012

(54) METHOD FOR PRODUCTION OF INK-JET HEAD

(75) Inventor: Takehiro Matsushita, Hachioji (JP)

(73) Assignee: Konica Minolta IJ Technologies, Inc., Tokyo (JP)

( * ) Notice: Subject to any disclaimer, the term of this patent is extended or adjusted under 35 U.S.C. 154(b) by 199 days.

(21) Appl. No.: 12/995,155

(22) PCT Filed: May 26, 2009

(86) PCT No.: PCT/JP2009/059582

§ 371 (c)(1),
(2), (4) Date: Nov. 29, 2010

(87) PCT Pub. No.: WO2009/147970

PCT Pub. Date: Dec. 10, 2009

(65) Prior Publication Data

US 2011/0081493 A1 Apr. 7, 2011

(30) Foreign Application Priority Data

Jun. 4, 2008 (JP) ..... 2008-146679

(51) Int. Cl.
*B05D 3/02* (2006.01)

(52) U.S. Cl. ..... 427/384; 427/385.5

(58) Field of Classification Search ..... None
See application file for complete search history.

(56) References Cited

U.S. PATENT DOCUMENTS

| | | | | |
|---|---|---|---|---|
| 5,502,470 | A * | 3/1996 | Miyashita et al. | 347/45 |
| 5,796,415 | A * | 8/1998 | Inoue et al. | 347/45 |
| 6,156,824 | A * | 12/2000 | Yamada et al. | 523/462 |
| 2005/0068368 | A1 * | 3/2005 | Ishizuka et al. | 347/45 |
| 2006/0244770 | A1 * | 11/2006 | Nishijima | 347/1 |
| 2007/0202261 | A1 * | 8/2007 | Matsushita | 427/372.2 |

FOREIGN PATENT DOCUMENTS

| | | | |
|---|---|---|---|
| JP | 2001-246756 | A | 9/2001 |
| JP | 2004-330681 | A | 11/2004 |
| JP | 2006-044226 | A | 2/2006 |
| JP | 2007-253611 | A | 10/2007 |

* cited by examiner

*Primary Examiner* — Erma Cameron
(74) *Attorney, Agent, or Firm* — Holtz, Holtz, Goodman & Chick, PC

(57) ABSTRACT

Disclosed is a method for producing an ink-jet head which enables the formation of an ink-repellent layer having excellent ink ejection stability, excellent adhesion to a head base material and excellent pressure resistance in a simple manner. The method for producing an ink-jet head is characterized by applying a coating solution comprising a compound represented by Formula (1) and an aqueous dispersion of a fluororesin to an ink-ejecting surface of an ink-jet head to form an ink-repellent layer on the ink-ejecting surface.

16 Claims, 1 Drawing Sheet

METHOD FOR PRODUCTION OF INK-JET HEAD

This application is the U.S. national phase application of International Application PCT/JP2009/059582 filed May 26, 2009.

TECHNICAL FIELD

The present invention relates to an ink-jet recording head producing method having an ink-repellent layer exhibiting excellent ink repellency.

BACKGROUND OF THE INVENTION

Regarding an ink-jet recording head for recording an image by jetting fine droplets of ink, straightness of the flying course of ink droplets is strongly required for realizing the high quality image recording by constant stable ink jetting. When the ink adheres around the jetting nozzle, the course of the ink-jetted from the nozzle is deviated so that the straightness of the flying course of the ink droplets is lowered. Therefore, an ink repelling ability is provided onto the ink-ejecting surface of nozzle plate as the ink jetting surface by forming an ink-repellent layer so that the ink does not adhere around the jetting opening and the straightness of the ink flying course can be kept for ink jetting. As the ink repelling layer, a layer of fluororesin which is excellent in the ink repelling ability is usable, but the adhesiveness of such the fluororesin to the base material is low since the surface energy of the resin is low. When the adhesiveness to the base material is low, the ink repelling layer tends to be peeled off so that the stable jetting is hardly kept and the durability of the head is lowered.

So as to solve above problems, proposed is a method for improving the adhesiveness of a layer of fluororesin to the base material.

For example, disclosed is an ink-jet head which has an ink-repellent layer comprising fluorine containing polymer resin on a surface of orifice of inkjet head, provided thereon a structure having portion where perfluoro polyether chain or perfluoro alkyl chain bonds to (for example, Patent Document 1). According to the method described in Patent Document 1, ink-repellent layer which has high ink-repellency and abrasion resistance can be obtained. However, fluorine based solvent is necessary to form an ink-repellent layer and there exists issues in view of workability, environmental soundness or forming a uniform layer.

Further, disclosed is a production method of an inkjet recording head for forming ink-repellent layer on an ink jetting surface by using coating solution containing fluororesin aqueous dispersion and water-soluble polyamide-imide, and polyoxyethylene alkylether (for example, Patent Document 2). By the method described in Patent Document 2, an ink-repellent layer can be formed easily by using aqueous coating solution. Thus it exhibits excellent workability and environmental soundness and also in view of good adhesiveness to an ink-ejecting surface and realizing stable ejection, it has good performances. However, as the result of further investment by the applicant, it was found that it tends to form unevenness in formed ink-repellent layer and a slight variation in ejection performance, resulting in being necessary to further improvement.

Moreover, disclosed is an inkjet recording head having improved ejection stability in which amorphous resin having critical surface tension lower than 25 mN/m (for example, amorphous fluororesin having perfluoro polyether in main chain) bonds to nozzle plate base material through oxygen atom (for example, Patent Document 3). However, according to the method described in Patent Document 3, as well as a method described in Patent Document 1, non-aqueous solvent such as perfluorocarbon is required to form an ink-repellent layer and there exists issues in view of workability, environmental soundness or forming an uniform layer.

Further, disclosed is an inkjet head having improved ejection stability, ink repellency and abrasion resistance in which $SiO_2$ layer containing $SiO_2$ as main component is formed on ink jetting surface of a nozzle head, provided thereon ink-repellent layer formed by compound having alkoxy silane residue group bonded to a terminal of perfluoro polyether chain (for example, Patent Document 4). However, by the method described in Patent Document 4, in order to form an ink-repellent layer, productivity is low due to necessity of plural process. Furthermore, formed ink-repellent layer does not have enough adhesiveness to the base material and abrasion resistance.

PRIOR TECHNICAL DOCUMENT

Patent Document

Patent Document 1: Unexamined Japanese Patent Application (hereinafter, refers to as JP-A) No. 2004-330681
Patent Document 2: JP-A No. 2007-253611
Patent Document 3: JP-A No. 2001-246756
Patent Document 4: JP-A No. 2006-44226.

SUMMARY

Problems to be Solved by the Present Invention

In view of the foregoing, the present invention was achieved. An object of the present invention is to provide a method for producing an ink-jet head which enables the formation of an ink-repellent layer having excellent ink ejection stability, excellent adhesion to a head base material and excellent pressure resistance in a simple manner.

Means to Solve the Problems

The above object has been attained by the following constitutions:

1. A method for producing an ink-jet head comprising a step of applying a coating solution comprising a compound represented by Formula (1) and an aqueous dispersion of a fluororesin to an ink-ejecting surface of an ink-jet head to form an ink-repellent layer on the ink-ejecting surface, Formula (1):

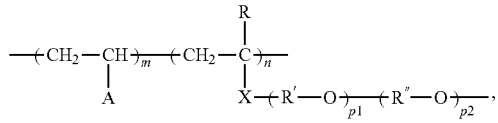

wherein A represents an alkyl group having carbon number of 1 to 6 containing fluorine atom as a substituent, R represents a hydrogen atom or a methyl group, X represents COO or O, R' and R" each represents a perfluoroalkylene group, m and n each represents an integer of 1 to 10,000, m+n is 10 to 10,000, and p1+p2 represents an integer of 1 to 20.

2. The method for producing an ink-jet head of item 1 further comprising a step of heat-treating in a temperature range of 300° C. or more and 400° C. or less, after applying the coating solution on the ink-ejecting surface.

3. The method for producing an ink-jet head of item 1 or 2, wherein the fluororesin is a tetrafluoroethylene/hexafluoropropylene copolymer.

4. The method for producing an ink-jet head of any one of items 1 to 3, wherein the coating solution comprises a thermoplastic resin.

5. The method for producing an ink-jet head of any one of items 1 to 4, wherein the thermoplastic resin is a water-soluble polyamide-imide resin.

Effects of the Invention

The present invention made it possible to provide a method for producing an ink-jet head which enables the formation of an ink-repellent layer having excellent ink ejection stability, excellent adhesion to a head base material and excellent pressure resistance in a simple manner.

DESCRIPTION OF THE PREFERRED EMBODIMENT

Figure 1:
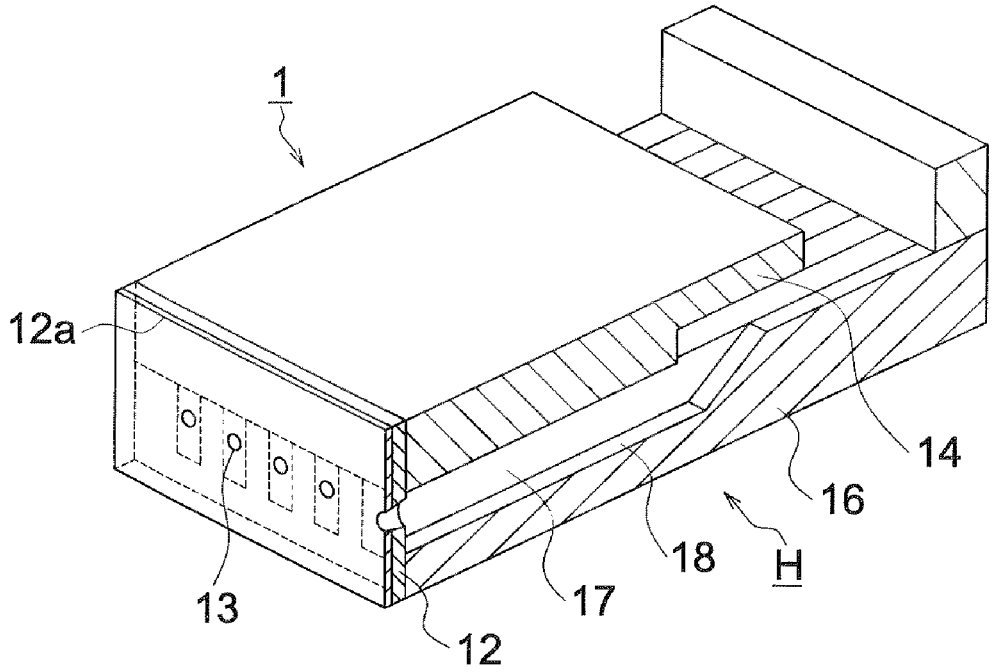
FIG. 1 shows a schematic perspective view of an example of ink-jet recording head.

An optimal embodiment to practice the present invention will now be detailed.

In view of the foregoing, the inventors of the present invention conducted diligent investigations. As a result the following was discovered, and the present invention was achieved. By the method for producing an ink-jet head which is characterized by applying a coating solution comprising an aqueous dispersion of a compound represented by Formula (1) and a fluororesin to an ink-ejecting surface of an ink-jet head to form an ink-repellent layer on the ink-ejecting surface, excellent economic efficiency, safety and environmental soundness can be obtained due to form ink-repellent layer by using aqueous coating liquid in a simple manner, coating uniformity can be tremendously improved by prevent agglomeration of fluororesin particles in coating liquid effectively; and further ink-repellent layer having excellent ink repellency and durability can be formed by efficiently orientating fluorine atoms on the surface of ink-repellent layer.

In addition to above constitution defined by the present invention, coexisting of thermoplastic resin preferably water-soluble polyamide-imide resin in a coating liquid for ink-repellent layer results in enhancing adhesiveness of ink-repellent layer to the head base material and also abrasion resistance. Thus it is one of preferable embodiment.

The present invention will be described in details as below.

<<Ink-jet Head>>

At first, a basic constitution of the ink-jet head related to the present invention will now be exemplified with reference to the drawing, however the present invention is not limited thereto.

Figure 2:
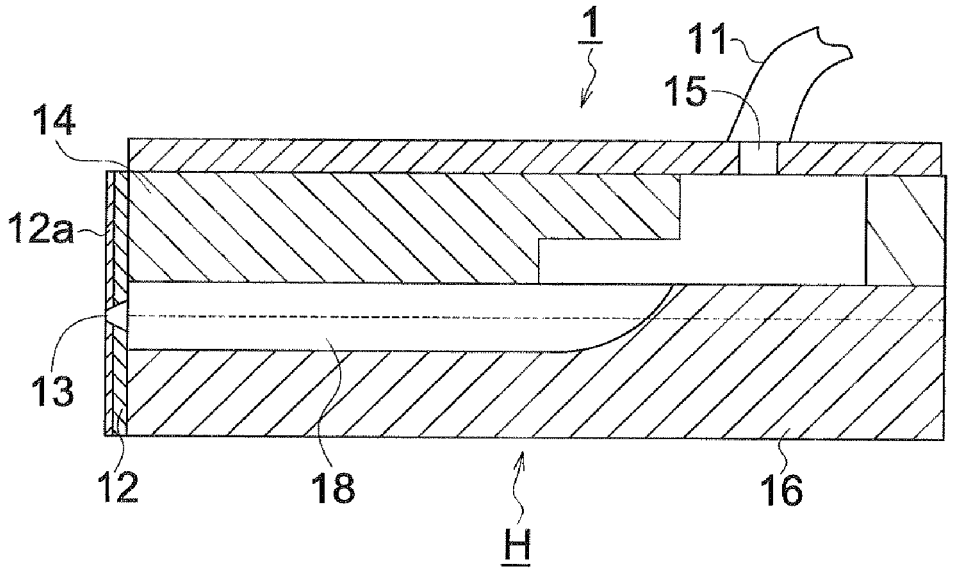
FIG. 2 shows a cross-sectional view of an example of ink-jet recording head.

FIGS. 1 and 2 show an example of constitution of the ink-jet recording head. FIG. 1 shows a schematic perspective view of an example of ink-jet recording head. FIG. 2 shows a cross-sectional view of an example of ink-jet recording head.

In FIGS. 1 and 2, 1 is an ink-jet recording head, 11 is an ink tube, 12 is a nozzle constituting member (nozzle plate), 13 is nozzle, 14 is a cover plate, 15 is an ink supplying opening, 16 is base plate and 17 is a partition. An ink channel 18 is constituted by the partition 17, cover plate 14 and base plate 16.

The ink-jet recording head 1 is a share mode type recording head having plural ink channels 18 arranged in parallel between the cover plate 14 and the base plate 16, wherein the ink channels 18, a part of them are shown in the drawings, are each separated by partitions 17 which are constituted by a piezo material such as PZT (lead zirconate titanate) as an electro-mechanical conversing means.

For the nozzle constituting material 12, a material having mechanical strength, ink resistivity and high dimensional stability such as ceramics, metal, glass or resin can be used. The glass can be suitably selected from quarts, synthesized quarts and high purity glass, and the resin can be suitably elected from, for example, polyethylene terephthalate (PET), polyethylene naphtholate (PEN), polyimide (PI) and polyphenylene sulfide (PPS). Thickness of the nozzle constituting member 12 is preferably from about 50 μm to 500 μm.

The form of the partition 17 is varied by driving signals so as to vary the volume of the ink channel 18 and the ink is jetted from the nozzle 13 and replenished into the ink channel 18.

The ink-repellent layer 12*a* is formed on the outer surface of the nozzle constituting member 12, namely on the ink jetting surface.

As a method for forming the ink-repellent layer 12*a*, a conventional wet coating method such as spray coating, spin coating, brush coating, dip coating or wire bar coating by using aqueous coating solution having constitution of the present invention can be applied on the nozzle constituting member 12. In the invention, the layer having high adhesiveness can be formed by once coating and the coating can be carried out with high efficiency.

In the method for producing an ink-jet head of the present invention, the ink-repellent layer is formed by method in which the nozzle 13 is formed by laser irradiation after the formation of the ink-repellent layer 12*a* or the ink-repellent layer 12*a* is formed after formation of the nozzle 13.

The ink-jet recording head 1 is constituted in such a way that the ink channel 18 is formed by the partition 17 and the nozzle constituting member 12 on which the nozzles 13 are formed is jointed with the front face of main body of the head H.

<<Ink-Repellent Layer>>

The ink-repellent layer of the present invention is characterized to form an ink-repellent layer on the ink-ejecting surface by applying a coating solution comprising a compound represented by Formula (1) and an aqueous dispersion of a fluororesin.

[Compound Represented by Formula (1)]

Compound represented by Formula (1) related to the present invention is a nonionic fluorosurfactant. In Formula (1), A represents an alkyl group having carbon number of 1 to 6 containing fluorine atom as a substituent, R represents a hydrogen atom or a methyl group, X represents COO or O, R' and R" each represents a perfluomalkylene group, m and n each represents an integer of 1 to 10,000, m+n is 10 to 10,000, and p1+p2 represents an integer of 1 to 20.

As an alkyl group having carbon number of 1 to 6 containing fluorine atom represented by A, listed are perfluoroethyl group, 2,2,2-trifluoroethyl group, perfluoroethyl group, 3,3,3-trifluoropropyl group, perfluoropropyl group, 4,4,4-trifluorobutyl group, perfluorobutyl group, 5,5,5-trifluoropentyl group, perfluoropentyl group, 6,6,6-trifluorohexyl group and perfluorohexyl group.

R' and R" each represents a perfluoroalkylene group, for example, perfluoroethylene group, perfluoropropylene group, perfluoroisopropylene group, perfluorobutylene group and perfluoroisobutylene group. Of these, perfluoroethylene group and perfluoropropylene group are preferable. Further, R' and R" may be the same or different prefluoroalkylene group.

m and n each represents an integer of 1 to 10,000, preferably each represents an integer of 1 to 1,000.

The compounds represented by Formula (1) will now be exemplified, however the present invention is not limited thereto.

Formula (1)

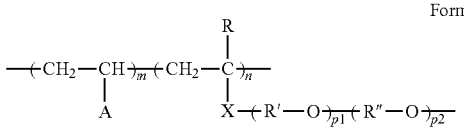

| Compound No. | A | R | X | R' | R" |
|---|---|---|---|---|---|
| 1 | $CF_3$ | H | COO | $CF_2$—$CF_2$ | — |
| 2 | $CF_3$ | H | COO | $CF_2$—$CF_2$ | $CF_2$—$CF(CF_3)$ |
| 3 | $CF_3$ | $CH_3$ | COO | $CF_2$—$CF_2$ | — |
| 4 | $CF_3$ | $CH_3$ | COO | $CF_2$—$CF_2$ | $CF_2$—$CF(CF_3)$ |
| 5 | $CF_3$ | $CH_3$ | COO | $CF_2$—$CF_2$ | $CF_2$—$C(CF_3)$ |
| 6 | $CF_3CH_2$ | $CH_3$ | COO | $CF_2$—$CF_2$ | — |
| 7 | $CF_3CH_2$ | $CH_3$ | COO | $CF_2$—$CF_2$ | $CF_2$—$CF(CF_3)$ |
| 8 | $CF_3CF_2$ | $CH_3$ | COO | $CF_2$—$CF_2$ | — |
| 9 | $CF_3CF_2$ | $CH_3$ | COO | $CF_2$—$CF_2$ | $CF_2$—$CF(CF_3)$ |
| 10 | $CF_3(CH_2)_2$ | $CH_3$ | COO | $CF_2$—$CF_2$ | — |
| 11 | $CF_3(CF_2)_2$ | $CH_3$ | COO | $CF_2$—$CF_2$ | $CF_2$—$CF(CF_3)$ |
| 12 | $CF_3(CH_2)_3$ | $CH_3$ | COO | $CF_2$—$CF_2$ | — |
| 13 | $CF_3(CF_2)_3$ | $CH_3$ | COO | $CF_2$—$CF_2$ | $CF_2$—$CF(CF_3)$ |
| 14 | $CF_3(CH_2)_4$ | $CH_3$ | COO | $CF_2$—$CF_2$ | — |
| 15 | $CF_3(CF_2)_4$ | $CH_3$ | COO | $CF_2$—$CF_2$ | $CF_2$—$CF(CF_3)$ |
| 16 | $CF_3(CH_2)_5$ | $CH_3$ | COO | $CF_2$—$CF_2$ | — |
| 17 | $CF_3(CF_2)_5$ | $CH_3$ | COO | $CF_2$—$CF_2$ | $CF_2$—$CF(CF_3)$ |
| 18 | $CF_3$ | H | O | $CF_2$—$CF_2$ | — |
| 19 | $CF_3$ | H | O | $CF_2$—$CF_2$ | $CF_2$—$CF(CF_3)$ |
| 20 | $CF_3$ | $CH_3$ | O | $CF_2$—$CF_2$ | — |
| 21 | $CF_3$ | $CH_3$ | O | $CF_2$—$CF_2$ | $CF_2$—$CF(CF_3)$ |
| 22 | $CF_3CF_2$ | $CH_3$ | O | $CF_2$—$CF_2$ | $CF_2$—$CF(CF_3)$ |
| 23 | $CF_3(CF_2)_2$ | $CH_3$ | O | $CF_2$—$CF_2$ | $CF_2$—$CF(CF_3)$ |
| 24 | $CF_3(CF_2)_3$ | $CH_3$ | O | $CF_2$—$CF_2$ | $CF_2$—$CF(CF_3)$ |
| 25 | $CF_3(CF_2)_4$ | $CH_3$ | O | $CF_2$—$CF_2$ | $CF_2$—$CF(CF_3)$ |
| 26 | $CF_3(CF_2)_5$ | $CH_3$ | O | $CF_2$—$CF_2$ | $CF_2$—$CF(CF_3)$ |

The compound represented by Formula (1) related to the present invention can be synthesized based on a synthesis method described in the conventional synthesis method such as JP-A 2004-330681 and JP-A 2006-44226. Further, the compound represented by Formula (1) related to the present invention can be obtained as a commercialized product, such as Surflon series manufactured by Seimi Chemical Co., Ltd.

The compound represented by Formula (1) related to the present invention is water soluble and may be soluble by using an auxiliary solvent such as ethanol, isopropanol and acetic ester.

The addition amount of the compound represented by Formula (1) related to the present invention to a coating liquid for forming ink-repellent layer is not particularly limited, but is 0.1-10% by mass, preferably 0.5-5% by mass, and most preferably 1-3% by mass.

[Fluororesin]

A fluororesin is used as the material for forming the ink-repellent layer and the coating liquid of the invention contains an aqueous dispersion of the fluororesin.

As the fluororesin, polytetrafluoroethylene (PTFE), tetrafluoroethylene-perfluoroalkyl vinyl ether copolymer (PFA), tetrafluoroethylene-hexafluoropropylene copolymer (FEP), tetrafluoroethylene-ethylene copolymer (ETFE), polychlorotrifluoroethylene (PCTFE) and poly(vinylidene fluoride) (PVDF) are usable but is not particularly limited thereto and EFP is preferable because which exhibits low in critical surface tension, excellent ink repelling ability and low viscosity in molten state at a temperature of thermal treatment of from 300 to 400° C. so as to be able to form a uniform layer.

In the present invention, the fluororesin is used in state of fine particles, namely in a dispersion state in an aqueous solution.

An average diameter of the fluororesin fine particles related to the present invention is not particularly limited. A primary average diameter is preferably more than 0.02 μm and less than 0.20 μm. When a primary average diameter is less than 0.02 μm, stability of dispersion decreases and agglomeration between fluororesin fine particles occurs, resulting in being difficult in forming uniform dispersion. When a primary average diameter is more than 0.20 μm, agglomerated particles tend to form by sedimentation. Thus, both conditions out of above range interfere with forming uniform ink-repellent layer.

Above primary average diameter can be determined by dynamic light scattering method (for example, DLS-6000 manufactured by Otsuka Electronics Co., Ltd.), laser diffraction method or centrifugal sedimentation method.

A content of fluororesin in a coating liquid for forming the ink-repellent layer related to the present invention is preferably 10-70% by mass, more preferably 20-50% by mass, most preferably 30-40% by mass.

[Thermoplastic Resin]

In a coating liquid for forming the ink-repellent layer related to the present invention, in view of enhancing adhesiveness of formed ink-repellent layer to the head base material and abrasion resistance, thermoplastic resin is used as well as an aqueous dispersion of a compound represented by Formula (1) and a fluororesin.

Specific examples of the thermoplastic resin applicable to the present invention include: polyethylene, polypropylene, polyvinylacetate, polyvinylalcohol, polyvinylacetal, copolymer of poly(meth)acrylic acid, poly(meth)acrylic ester, polyacrylic acid derivatives, polyamide acrylate, polyether, polyester, polycarbonate, cellulose based resin, polyacrylonitrile, polyimide, polyamide (nylon), polyamide-imide, polyvinylchloride, polyvinylidenechloride, polystyrene, Thiokol, polysulfone, polyurethane, and copolymer of monomers of these resins. Of these, polyamide-imide resin is preferred in view of excellent effect of enhancing dispersability of fluororesin fine particles and forming uniform layer as well as enhancing adhesiveness of formed ink-repellent layer to the base material, because that polyamide-imide resin has effect of enhancing adhesiveness of formed ink-repellent layer to the base material.

Above polyamide-imide resin is generally insoluble in water. Therefore, a water-soluble polyamide-imide resin is preferable to the present invention.

In the method for producing an ink-jet head of the present invention, when uniform coating liquid containing a water-soluble polyamide-imide resin is used, polyamide-imide resin is eccentrically-located near a surface of nozzle material due to having capability to bond to nozzle constituting member. Thus, a constitution can be formed in which compound represented by Formula (1) and fluororesin are eccentrically-located near a surface of ink-repellent layer and adhesiveness is enhanced due to no boundary within ink-repellent layer. Further, due to use water based coating solution, there are advantages on environmental soundness, safety and economical stand point.

The water-soluble polyamide-imide preferably used in the present invention is represented by the following Formula (2).

Formula (2):

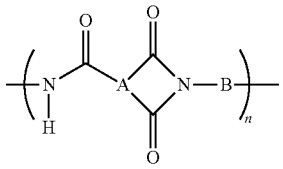

In Formula (2), A represents trivalent organic acid group, and B represents divalent organic acid group.

Specific examples of trivalent organic acid group represented by A in Formula (2) include: ethane-triyl group, propane-triyl group, butane-triyl group, pentane-triyl group, hexane-triyl group, heptane-triyl group, octane-triyl group, nonane-triyl group, decane-triyl group, undecane-triyl group, dodecane-triyl group, cyclohexane-triyl group, cyclopentane-triyl group, benzene-triyl group, naphthalene-triyl group or organic group formed whereby above divalent aromatic group or group having divalent heterocyclic ring each further has single bond, divalent saturated hydrocarbon group, or divalent unsaturated hydrocarbon group.

Further, specific examples of divalent organic acid group represented by B in Formula (2) include: group having divalent saturated hydrocarbon, group having divalent unsaturated hydrocarbon, group having divalent aromatic group or group having divalent heterocyclic ring.

Specific examples of group having divalent saturated hydrocarbon represented by B in Formula (2) include: ethylene group, trimethylene group, tetramethylene group, propylene group, ethyl ethylene group, pentamethylene group, hexamethylene group, 2,2,4-trimethylhexamethylene group, heptamethylene group, octamethylene group, nonamethylene group, decamethylene group, undecamethylene group, dodecamethylene group, cyclohexylene group (for example, 1,6-cyclohexane-diyl), and cyclopentylene group (for example, 1,5-cyclopentane-diyl).

Group having divalent unsaturated hydrocarbon represented by B in Formula (2) represents a group formed by replacing at least one bond between two carbon atoms in above divalent saturated hydrocarbon group by unsaturated bond such as double bond or triple bond. Specific examples include propenylene group, vinylene group (referred to as ethynylene group) and 4-propyl-2-pentenylene group.

Specific examples of group having divalent aromatic group represented by B include: phenylene group, naphthylene group, pyridine-diyl group, pyrrole-diyl group, thiophene-diyl group and furan-diyl group.

Specific examples of group having divalent heterocyclic ring represented by B include: oxazole-diyl group, pyrimidine-diyl group, pyridazine-diyl group, pyrane-diyl group, pyrroline-diyl, imidazoline-diyl group, imidazolidine-diyl group, pyrazolidine-diyl, pyrazoline-diyl group, piperidine-diyl group, piperazine-diyl group, morpholine-diyl group and quinuclidine-diyl group.

Above divalent group may have further substituent group.

Water-soluble polyamide-imide resin of the present invention can be obtained by mixing and stirring polyamide-imide resin with basic compound such as amine compound in a basic polar solution, and by gradually adding water. Further, water-soluble polyamide-imide resin of the present invention can be obtained by commercialized product. For example, HPC-1000 manufactured by Hitachi Chemical Co., Ltd. is listed.

A content of water-soluble polyamide-imide resin in a coating solution for the ink-repellent layer of the present invention is not particularly limited, but preferably in the range of 5-40% by mass, more preferably 10-35% by mass, the most preferably 20-30% by mass.

[Formation of Ink-Repellent Layer]

Ink-repellent layer is formed by coating an aqueous coating solution for the ink-repellent layer containing several constituent materials above on a nozzle constituting material and drying.

As for the nozzle constituting material applicable to the present invention, ceramics, metal, glass (for example, quarts, synthesized quarts and high purity glass), or resin (for example, polyethylene terephthalate (PET), polyethylene naphthalate (PEN), polyimide (PI) and polyphenylene sulfide (PPS)) can be used. Thickness of the nozzle constituting member is preferably from about 50 μm to 500 μm.

The surface of the nozzle constituting member may be activated previous to the coating for raising the wettability of the nozzle constituting member as the nozzle constituting member for the coating liquid.

For the activation treatment, treatment by plasma, corona, ozone, UV or excimer laser can be applied.

As a method for forming the ink-repellent layer on the activated nozzle constituting member by using aqueous coating solution for the ink-repellent layer having several constitution materials, a conventional wet coating method such as spin coating, dip coating, extrusion coating, roll coating, spray coating, brush coating, gravure coating, wire bar coating or air knife coating can be applied. In the coating method by using aqueous coating solution for the ink-repellent layer of the invention, the layer having high adhesiveness and excellent ink repellency can be formed by once coating and the coating can be carried out with high efficiency. After coating, water in the ink-repellent layer of the nozzle constituting member is eliminated by following drying process.

In the present invention, after coating and drying the ink-repellent layer on the nozzle constituting member according to above method, the coated layer is treated by heating at the treating temperature of from 300° C. to 400° C. Heat treatment on the ink-repellent layer increases a fluidity of the ink-repellent layer and fluororesin and fluorine atom in fluorine based surfactant represented by Formula (1) tends to be orientated at the outermost of the ink-repellent layer, resulting in excellent ink repellency and abrasion resistance. Moreover, when above thermoplastic resin, for example water-soluble polyamide-imide resin is contained in the ink-repellent layer, the thermoplastic resin is melted at the temperature of from 300° C. to 400° C., resulting in enhancing adhesiveness to the nozzle constituting member.

EXAMPLES

Embodiments of the present invention will now be specifically described with the reference to examples, however the present invention is not limited thereto. Incidentally, the expression of "part" or "%" referred to in Examples represents "part by mass" or "% by mass" unless otherwise specified.

<<Preparation of Nozzle Sheet>>

[Preparation of Nozzle Sheet 1]

Onto one side of a polyimide sheet (Upilex manufactured by Ube Kosan) having thickness of 75 μm as a nozzle constituting member, a coating solution of an ink-repellent layer 1 below was coated via wire bar under a condition of a layer thickness of 50 μm and followed by drying to obtain Nozzle Sheet 1.

| (Coating solution 1 for Ink-repellent layer) | |
|---|---|
| FEP (Tetrafluoroethylene-hexafluoropropylene copolymer, ND-1 manufactured by Daikin Industry, Ltd.) | solid content 32% by mass |
| Coating solution 1 for Ink-repellent layer was prepared by diluting with pure water | to 100% by mass. |

[Preparation of Nozzle Sheet 2]

Nozzle sheet 2 was prepared in the same manner as preparation of nozzle sheet 1 except for using coating solution 2 for ink-repellent layer below instead of coating solution 1 for Ink-repellent layer.

| (Coating solution 2 for Ink-repellent layer) | |
|---|---|
| FEP (Tetrafluoroethylene-hexafluoropropylene copolymer, ND-1 manufactured by Daikin Industry, Ltd.) | solid content 32% by mass |
| PAI (Water-soluble polyamide-imide resin, HPC-1000-28: manufactured by Hitachi Chemical Co., Ltd) | solid content 24% by mass |
| Coating solution 2 for Ink-repellent layer was prepared by diluting with pure water | to 100% by mass. |

[Preparation of Nozzle Sheet 3]

Nozzle sheet 3 was prepared in the same mariner as preparation of nozzle sheet 2 except for using coating solution 3 for ink-repellent layer in which surfactant A (polyethyleneglycol monododecylether) was added at 5% by mass based on solid content to coating solution 2 for Ink-repellent layer instead of coating solution 2 for Ink-repellent layer.

[Preparation of Nozzle Sheet 4]

Nozzle sheet 4 was prepared in the same manner as preparation of nozzle sheet 3 except for heat-treating 4 hours at 350° C. after coating and drying ink-repellent layer.

[Preparation of Nozzle Sheet 5]

Nozzle sheet 5 was prepared in the same manner as preparation of nozzle sheet 4 except for using coating solution 4 below for ink-repellent layer instead of coating solution 3 for ink-repellent layer.

| (Coating solution 4 for Ink-repellent layer) | |
|---|---|
| FEP (Tetrafluoroethylene-hexafluoropropylene copolymer, ND-1 manufactured by Daikin Industry, Ltd.) | solid content 32% by mass |
| Exemplified compound 4 | solid content 0.5% by mass |
| PAI (Water-soluble polyamide-imide resin, HPC-1000-28: manufactured by Hitachi Chemical Co., Ltd) | solid content 24% by mass |
| Coating solution 4 for Ink-repellent layer was prepared by diluting with pure water | to 100% by mass. |

[Preparation of Nozzle Sheets 6-8]

Nozzle sheets 6-8 were prepared in the same manner as preparation of nozzle sheet 5 except for using coating solution 5, 6 and 7 for ink-repellent layer in which content of exemplified compound 4 in coating solution 4 for ink-repellent layer was respectively changed to 1.0% by mass, 3.0% by mass and 5.0% by mass.

[Preparation of Nozzle Sheet 9]

Nozzle sheet 9 was prepared in the same manner as preparation of nozzle sheet 7 except for using coating solution 8 for ink-repellent layer in which PAI (water-soluble polyamide-imide resin) was eliminated in coating solution 6 for ink-repellent layer.

[Preparation of Nozzle Sheet 10]

Nozzle sheet 10 was prepared in the same manner as preparation of nozzle sheet 7 except for eliminating heat-treatment after coating and drying ink-repellent layer.

[Preparation of Nozzle Sheets 11-15]

Nozzle sheets 11-15 were prepared in the same manner as preparation of nozzle sheet 7 except for using coating solutions 9, 10, 11, 12 and 13 for ink-repellent layer in which exemplified compound 4 in coating solution 6 for ink-repellent layer was respectively changed to exemplified compounds 2, 3, 7, 17 and 21.

[Preparation of Nozzle Sheets 16-18]

Nozzle sheets 16-18 were prepared in the same manner as preparation of nozzle sheet 7 except for changing heat treatment temperature to 150° C., 250° C. and 450° C., respectively.

TABLE 1

| Nozzle | Coating | Coating solution of Ink-repellent layer | | | | | | | | | |
|---|---|---|---|---|---|---|---|---|---|---|---|
| | | Fluororesin | | Formula (1) | | Thermoplastic resin | | Surfactant A | Heat treatment | | |
| plate No. | liquid No. | Species | Content (*) | Species | Content (*) | Species | Content (*) | Content (*) | With or without | Temperature (° C.) | Remark |
| 1 | 1 | FEP | 32 | — | — | — | — | — | without | — | Comp. |
| 2 | 2 | FEP | 32 | — | — | PAI | 24 | — | without | — | Comp. |
| 3 | 3 | FEP | 32 | — | — | PAI | 24 | 5 | without | — | Comp. |
| 4 | 3 | FEP | 32 | — | — | PAI | 24 | 5 | With | 350 | Comp, |
| 5 | 4 | FEP | 32 | Compound 4 | 0.5 | PAI | 24 | — | With | 350 | Inv. |
| 6 | 5 | FEP | 32 | Compound 4 | 1.0 | PAI | 24 | — | With | 350 | Inv. |
| 7 | 6 | FEP | 32 | Compound 4 | 3.0 | PAI | 24 | — | With | 350 | Inv. |
| 8 | 7 | FEP | 32 | Compound 4 | 5.0 | PAI | 24 | — | With | 350 | Inv. |
| 9 | 8 | FEP | 32 | Compound 4 | 3.0 | — | — | — | With | 350 | Inv. |
| 10 | 6 | FEP | 32 | Compound 4 | 3.0 | PAI | 24 | — | without | — | Inv. |
| 11 | 9 | FEP | 32 | Compound 2 | 3.0 | PAI | 24 | — | With | 350 | Inv. |
| 12 | 10 | FEP | 32 | Compound 3 | 3.0 | PAI | 24 | — | With | 350 | Inv. |
| 13 | 11 | FEP | 32 | Compound 7 | 3.0 | PAI | 24 | — | With | 350 | Inv. |
| 14 | 12 | FEP | 32 | Compound 17 | 3.0 | PAI | 24 | — | With | 350 | Inv. |
| 15 | 13 | FEP | 32 | Compound 21 | 3.0 | PAI | 24 | — | With | 350 | Inv. |
| 16 | 6 | FEP | 32 | Compound 3 | 3.0 | PAI | 24 | — | With | 150 | Inv. |

TABLE 1-continued

| Nozzle plate No. | Coating liquid No. | Coating solution of Ink-repellent layer: Fluororesin Species | Fluororesin Content (*) | Formula (1) Species | Formula (1) Content (*) | Thermoplastic resin Species | Thermoplastic resin Content (*) | Surfactant A Content (*) | Heat treatment With or without | Heat treatment Temperature (° C.) | Remark |
|---|---|---|---|---|---|---|---|---|---|---|---|
| 17 | 6 | FEP | 32 | Compound 3 | 3.0 | PAI | 24 | — | With | 250 | Inv. |
| 18 | 6 | FEP | 32 | Compound 3 | 3.0 | PAI | 24 | — | With | 450 | Inv. |

(*)Solid content in coating solution (% by mass), Comp.: Comparative example, Inv.: Inventive example Herein, each additive described in an abbreviated name in Table 1 is as follows:

FEP: Tetrafluoroethylene-hexafluoropropylene copolymer, ND-1 manufactured by Daikin Industry, Ltd PAI: Water-soluble polyamide-imide resin, HPC-1000-28: manufactured by Hitachi Chemical Co., Ltd Surfactant A: Polyethyleneglycol monododecylether <<Evaluation of Nozzle plate>>

[Evaluation of Ink Repellency]

Receding contact angle θ1 of ink-repellent layer surface of nozzle plate prepared above was measured by following method and used as the standard of ink repellency. Higher receding contact angle represents excellent ink repellency.

(Measurement of Receding Contact Angle)

The receding contact angle θ1 was measured by using Contact angle meter CA-X produced by Kyowa Interface Science Co., Ltd according to following procedure: a following ink liquid used as a test liquid was dropped onto a surface of an ink-repellent layer formed on a nozzle plate by using provided microsyringe under a condition of initial drop size=15 μl, suction rate=5 μl/sec, followed by measuring a contact angle when ink drop diminishes.

<Preparation of Ink liquid>

Ink liquid for evaluation of receding contact angle and ejection stability described later was prepared by mixing and solving following additives.

| | |
|---|---|
| Dispersed pigment (C.I. Pigment Yellow) | 2% by mass |
| Binder resin (Styrene-acrylic acid copolymer) | 5% by mass |
| Diethyleneglycol diethylether | 88% by mass |
| N-pyrolidone | 5% by mass |

[Evaluation of Abrasion Resistance]

Each of the surface of the nozzle plates on which the ink-repellent layer was formed was rubbed for 100 times by non-woven cloth and the receding contact angle θ2 after the rubbing of the surface was measured with Contact angle meter CA-X produced by Kyowa Interface Science Co., Ltd. by using above ink liquid.

When no decline was observed in the receding contact angle θ2 after the rubbing comparing to the receding contact angle θ1 for untreated state, abrasion resistance was determined to be excellent.

[Evaluation of Layer Uniformity]

Surface of the ink-repellent layer of nozzle plate prepared above was visually inspected and layer uniformity was evaluated according to following criteria:

A: No asperity and uneven thickness was observed and layer was extremely smooth and uniform.

B. Nearly no asperity and uneven thickness was observed but layer was smooth and uniform.

C: Asperity and uneven thickness was observed in some part but layer was nearly smooth and uniform.

D: Markedly asperity and uneven thickness was observed, resulting in practically unaccepted quality.

[Evaluation of Adhesiveness]

Grid test based on JIS K 5400 were prepared. With respect to the surface of the ink-repellent layer of nozzle plate, 11 lines of length and breadth notches were formed on the surface at 1 mm intervals to form 100 grids of 1 mm square, Celotape (registered mark) being pasted up on each surface, being quickly peeled off at an angle of 90 degree, and the state of peeling or grids remained without peeling was evaluated based on the following criteria.

A: No peeling-off of ink-repellent layer is observed in the grid test.

B: Slight float is observed in part of grid but without peeling, which is good quality.

C: Peeling of 1-5 grids was noted, which is, however, practically acceptable.

D: Peeling of 6 grids or more was apparently noted, resulting in practically unaccepted quality.

[Evaluation of Ejection Stability]

Nozzle plates 1-15 for ink-jet heads were prepared by forming nozzle holes on each nozzle plate by using excimer laser under the condition of nozzle diameter 25 μm, number of nozzles 128, and nozzle density 180 dpi. Herein, "dpi" represents the number of dots per 2.54 cm.

Subsequently, by pasting the nozzle plate on the ink ejecting side of the ink-jet head having constitutions described in FIG. 1, piezo type ink-jet head having nozzle diameter 25 μm, driving frequency of 12 kHz, number of nozzles 128, and nozzle density 180 dpi was prepared.

In each ink-jet heads, above ink liquid were filled and after 1 hour-continuous ejection, at an ambient of 20° C., 30% R.H., and under the condition of 12 pl per 1 drop, intermittent ejection such as 10 second-continuous ejection, then resting ejection in constant time, and again continuous ejection was carried out. Whether disturbed direction of ejection occurs or not at first ejection immediately after resting ejection depends on a length of pausing time. Therefore, continuous ejection stability was measured by changing length of resting time in a stepwise and evaluated based on the following criteria.

A: Ejection was stable after resting ejection in 31-45 seconds.

B: Ejection was stable after resting ejection in 21-30 seconds.

C: Ejection was stable after resting ejection in 11-20 seconds.

D: Ejection was stable only within 10 seconds.

TABLE 2

| Nozzle plate No. | Receding contact angle (°) Ink repellency Immediately after preparation θ1 | Abrasion resistance After rubbing θ2 | Layer uniformity | Adhesive-ness | Ejection stability | Remark |
|---|---|---|---|---|---|---|
| 1 | 31 | 4 | D | D | D | Comp. |
| 2 | 43 | 6 | D | C | D | Comp. |
| 3 | 41 | 8 | D | C | C | Comp. |
| 4 | 44 | 7 | D | B | C | Comp. |
| 5 | 45 | 20 | B | B | B | Inv. |
| 6 | 46 | 24 | B | B | A | Inv. |
| 7 | 48 | 36 | A | A | A | Inv. |
| 8 | 51 | 39 | A | A | A | Inv. |
| 9 | 46 | 34 | B | B | B | Inv. |
| 10 | 42 | 31 | B | C | B | Inv. |
| 11 | 45 | 37 | A | A | A | Inv. |
| 12 | 46 | 35 | A | A | A | Inv. |
| 13 | 48 | 38 | A | A | A | Inv. |
| 14 | 47 | 37 | A | A | A | Inv. |
| 15 | 46 | 35 | A | A | A | Inv. |
| 16 | 46 | 34 | B | B | B | Inv. |
| 17 | 47 | 34 | B | A | A | Inv. |
| 18 | 48 | 37 | A | A | A | Inv. |

* Comp.: Comparative. Inv.: Inventive

As can clearly seen from Table 2, the nozzle plate having the ink-repellant layer according to the present invention were superior to Comparative Examples in each of the ink-repellency, abrasion resistance, layer uniformity, adhesion to a head base material and ink ejection stability.

| Description of the Alphanumeric Designations | |
|---|---|
| 1 | Ink-jet recording head |
| 12 | Nozzle constituting material |
| 12a | Ink-repellent layer |

What is claimed is:

1. A method for producing an ink-jet head comprising a step of:

applying a coating solution comprising a compound represented by Formula (1) and an aqueous dispersion of a fluororesin to an ink-ejecting surface of an ink-jet head to form an ink-repellent layer on the ink-ejecting surface, Formula (1):

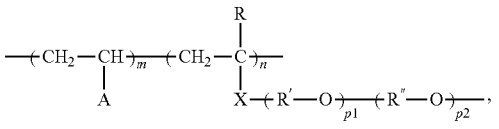

wherein A represents an alkyl group having carbon number of 1 to 6 containing fluorine atom as a substituent, R represents a hydrogen atom or a methyl group, X represents COO or O, R' and R" each represents a perfluoroalkylene group, m and n each represents an integer of 1 to 10,000, m+n is 10 to 10,000, and p1+p2 represents an integer of 1 to 20.

2. The method for producing an ink-jet head of claim 1 further comprising a step of heat-treating in a temperature range of 300° C. or more and 400° C. or less, after applying the coating solution on the ink-ejecting surface.

3. The method for producing an ink-jet head of claim 1, wherein the fluororesin is a tetrafluoroethylene/hexafluoropropylene copolymer.

4. The method for producing an ink-jet head of claim 1, wherein the coating solution comprises a thermoplastic resin.

5. The method for producing an ink-jet head of claim 4, wherein the thermoplastic resin is a water-soluble polyamide-imide resin.

6. The method for producing an ink-jet head of claim 2, wherein the fluororesin is a tetrafluoroethylene/hexafluoropropylene copolymer.

7. The method for producing an ink-jet head of claim 2, wherein the coating solution comprises a thermoplastic resin.

8. The method for producing an ink-jet head of claim 3, wherein the coating solution comprises a thermoplastic resin.

9. The method for producing an ink-jet head of claim 6, wherein the coating solution comprises a thermoplastic resin.

10. The method for producing an ink-jet head of claim 7, wherein the thermoplastic resin is a water-soluble polyamide-imide resin.

11. The method for producing an ink-jet head of claim 8, wherein the thermoplastic resin is a water-soluble polyamide-imide resin.

12. The method for producing an ink-jet head of claim 9, wherein the thermoplastic resin is a water-soluble polyamide-imide resin.

13. The method for producing an ink-jet head of claim 1, wherein the coating solution comprises a water-soluble polyamide-imide resin.

14. The method for producing an ink-jet head of claim 2, wherein the coating solution comprises a water-soluble polyamide-imide resin.

15. The method for producing an ink-jet head of claim 3, wherein the coating solution comprises a water-soluble polyamide-imide resin.

16. The method for producing an ink-jet head of claim 6, wherein the coating solution comprises a water-soluble polyamide-imide resin.

* * * * *